United States Patent [19]

Hately

[11] Patent Number: 4,630,061

[45] Date of Patent: Dec. 16, 1986

[54] ANTENNA WITH UNBALANCED FEED

[75] Inventor: Maurice C. Hately, Aberdeen, Scotland

[73] Assignee: National Research Development Corp., London, England

[21] Appl. No.: 620,927

[22] Filed: Jun. 15, 1984

[30] Foreign Application Priority Data

Jun. 17, 1983 [GB] United Kingdom ..... 8316510

[51] Int. Cl.[4] ..... H01Q 1/50; H01Q 9/16

[52] U.S. Cl. ..... 343/749; 343/818; 343/840; 343/859; 343/821

[58] Field of Search ..... 343/859, 745, 747, 749, 343/802, 820–822, 856, 857, 860–862, 852, 840, 793, 752, 818, 819, 905

[56] References Cited

U.S. PATENT DOCUMENTS

| | | | |
|---|---|---|---|
| 2,235,139 | 1/1939 | Bruce | 343/795 |
| 2,241,582 | 5/1941 | Buschbeck et al. | 343/862 |
| 3,339,205 | 8/1967 | Smitka | 343/749 |

FOREIGN PATENT DOCUMENTS

| | | | |
|---|---|---|---|
| 297328 | 12/1929 | United Kingdom . | |
| 338028 | 11/1930 | United Kingdom . | |
| 470165 | 8/1937 | United Kingdom . | |
| 580812 | 9/1946 | United Kingdom . | |
| 890367 | 2/1962 | United Kingdom . | |
| 1182952 | 3/1970 | United Kingdom . | |
| 1307496 | 5/1970 | United Kingdom . | |
| 2086662 | 5/1982 | United Kingdom | 343/749 |
| 2107128 | 4/1983 | United Kingdom . | |
| 2112579 | 7/1983 | United Kingdom . | |

*Primary Examiner*—Eli Lieberman
*Assistant Examiner*—Michael C. Wimer
*Attorney, Agent, or Firm*—Cushman, Darby & Cushman

[57] ABSTRACT

In general a coaxial feeder connected directly into the center of a half-wave dipole antenna disturbs electrical balance and therefore reduces the effectiveness of the screen of the feeder. In the present invention a dipole with two quarter-wavelength elements symmetrically connected through respective identical capacitors to the screen of the feeder is fed through an inductor connected to the junction between one element and its capacitor. By having equal reactances, the capacitors balance the dipole to earth and by means of its phase delay the inductor restores a resistive impedance termination for the feeder.

10 Claims, 10 Drawing Figures

PRIOR ART

ANTENNA WITH UNBALANCED FEED

The present invention relates to feeding an antenna from an unbalanced feeder having "live" (or ungrounded) and "common" (or grounded) conductors, in such a way that the antenna is balanced with respect to ground and matched to the feeder. The invention is particularly useful for half-wave dipole antennas fed from coaxial feeders.

Balance can be achieved in the way described in U.S. Pat. No. 4,518,968 where two capacitors are connected in series between adjacent ends of the elements of a dipole, the screen of a coaxial feeder is connected to the connection between the capacitors and the centre conductor of the feeder is connected to one end (adjacent to the capacitors) of one of the elements. While the introduction of these capacitors improves the performance of the dipole, the inventor has found that matching is not optimum.

A half-wave dipole antenna can be considered as equivalent to a parallel resonant circuit formed by a capacitor, an inductor centre tapped to earth and a shunt resistor. The shunt resistor represents radiation loss and circuit component losses. In view of the high degree of coupling between the opposite halves of an open wire antenna the circuit representing the dipole antenna may be further simplified to two unbalanced back to back circuits each equivalent to half of the aforementioned resonant circuit and dissipating half the power. In such an arrangement the screen of a coaxial feeder is best connected to the electrical centre of the dipole but the best point for the inner of the coaxial feeder presents a problem.

A known technique is to connect the centre of the feeder to a tapping point some distance along one of the dipoles in an attempt to achieve an inductive tap on the inductance in one of the back to back equivalent circuits providing the equivalent of an auto-transformer. This type of antenna feed system has been called the Gamma match but unfortunately the length of wire connecting the feeder to the dipole constitutes a significant series inductance which presents an inductive load to the feeder. As a result the Gamma match has been found to be of little use and even when the series inductance is tuned out by a capacitor, the arrangement has not fulfilled its theoretical promise, due possibly to unwanted magnetic coupling between currents in the antenna and in the connection between the feeder and the dipole.

According to a first aspect of the present invention there is provided an antenna for connection to an unbalancd feeder having a predetermined characteristic resistance, comprising a conductive structure which is resonant at the centre frequency of a predetermined operating band, the structure having first and second elongated conductors, or elongated conductor portions, with one end of the first conductor or portion adjacent to one end of the second conductor or portion, a pair of capacitors connected in series between the said adjacent ends with the connection between the capacitors forming a connecting point for the 'common' connection of an unbalanced feeder, each capacitor having a capacitive reactance at the said centre frequency providing a phase shift of several tens of degrees between applied voltage and current, and an inductor having one end connected to one of the said ends, the other end forming a connecting point for the 'live' connection of an unbalanced feeder, and the inductor having an inductive reactance at the said centre frequency which compensates for the said phase shift.

To be resonant at the centre frequency, when the antenna is a dipole, the conductors should have lengths in the range 96 to 104% of any practical odd number of quarter freespace wavelengths at that frequency but if the conductors are thickened or widened for broad band operation, or are inductively loaded, their lengths should be appreciably shorter.

In effect the antenna is fed from the capacitive side of the equivalent resonant circuit. One of the capacitors together with the imaginary capacitor of one of the back to back circuits forms a potential divider stepping the characteristic resistance of the line to that of the resistance in the back to back circuit, and the inductor compensates for the reactance of the said one capacitor at the point where the line is connected so improving the matching of the antenna to the feeder.

Since the inductor may be a small component it can be contained in a fully weather-proofed housing, central to the dipole, which also contains the capacitors. Connections to and from the inductor can be kept short and then do not experience the inductive disturbance of the connection in the Gamma match. Since the reactance of the inductor is approximately equal to the characteristic impedance of the feeder, the equivalent resonant circuit has a Q factor of 1 and is therefore very broadband. The principal loss resistance is radiation damping and the only bandwidth restriction is provided by the resonant behaviour of the half-wave dipole antenna.

This latter advantage is also experienced by the antennas described in the above mentioned patent application. The antennas of the present invention, together with those of the above mentioned application, have the advantages of good electrical balance and therefore high degree of rejection of locally generated unwanted interference and good radiation efficiency due to the radiation circuit current being able to flow unimpeded by the source resistance since one of the capacitors is connected in parallel with the feeder.

According to a second aspect of the present invention there is provided an antenna for connection to an unbalanced feeder having a predetermined characteristic resistance, comprising a generally elongated conductive structure which is resonant at the centre frequency of a predetermined operating band, a ground plane conductor generally normal to the conductive structure and coupled to one end thereof by way of a capacitor having a capacitive reactance at the said centre frequency providing a phase shift of several tens of degrees between applied voltage and current, and an inductor having one end connected to the said one end of the conductive structure and the other end of the inductor forming a connecting point for the 'live' end of an unbalanced feeder, the inductor having an inductive reactance which compensates for the said phase shift.

The conductive structure of the second aspect of the invention may be an elongated conductor.

In the first and second aspects of the invention the or each capacitor preferably has a capacitive reactance at the said centre frequency within the range 90 to 110% of the characteristic resistance of the feeder, and the inductor has an inductive reactance within the said range.

The invention also comprises methods corresponding to the first and second aspects of the invention.

Certain embodiments of the invention will now be described by way of example, with reference to the accompanying drawings in which.

Figure 3A:
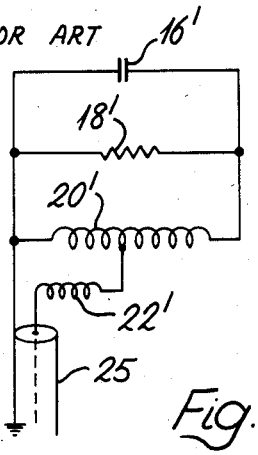
Fig. 3a PRIOR ART
Figure 3B:
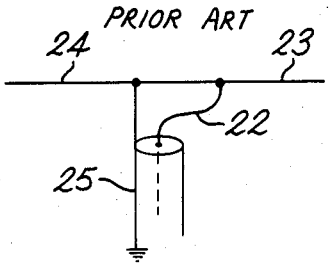
Figure 4A:
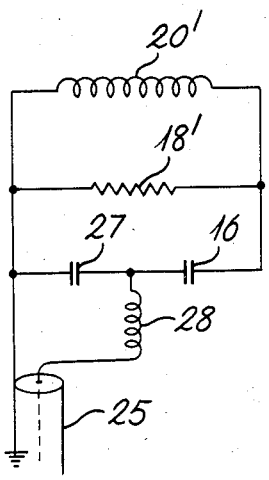
Figure 4B:
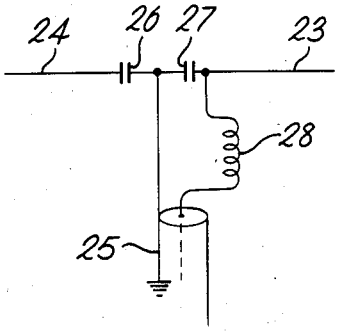
Figure 5:
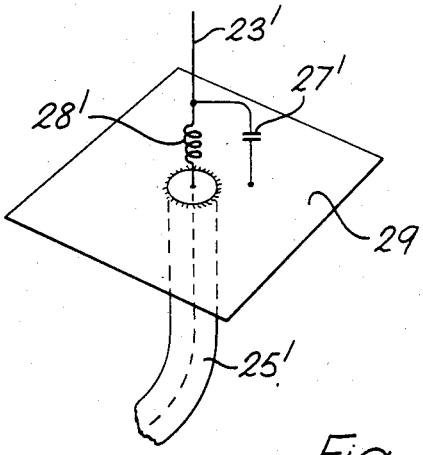
Figure 6:
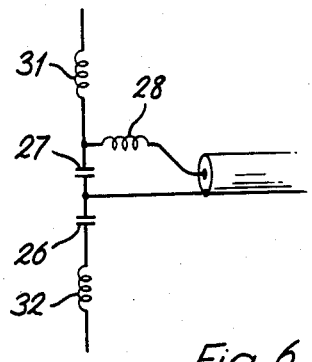
Figure 7:
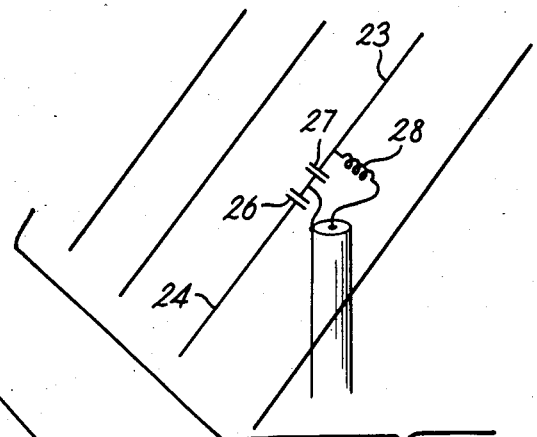
Figure 8:
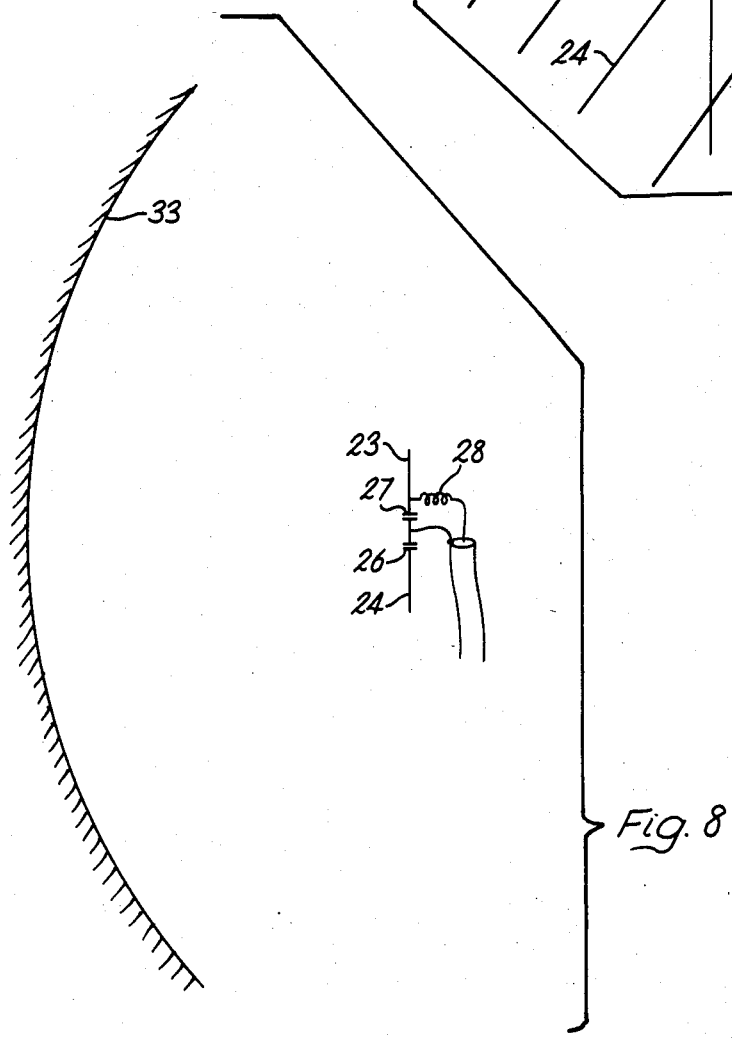

FIGS. 3*a* and 3*b* show a half equivalent circuit and schematic diagram of a prior art arrangement for feeding a half-wave dipole antenna from a coaxial feeder, FIGS. 4*a* and 4*b* shown an equivalent half circuit and schematic drawing, respectively, for an antenna according to the invention, FIG. 5 is a schematic drawing of a ground plane antenna according to the invention, FIG. 6 is a schematic drawing of an antenna according to the invention employing loading coils, FIG. 7 is a schematic drawing of a directional antenna according to the invention, and FIG. 8 is a schematic drawing of an antenna according to the invention employing a parabolic reflector.

Figure 1:
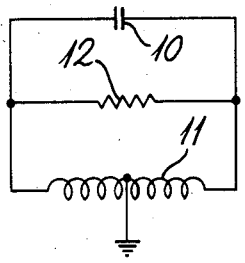
PRIOR ART Fig. 1
FIG. 1 is an equivalent circuit for a half-wave dipole antenna.

As has been mentioned a half-wave dipole antenna can be represented by a resonant circuit. Such a circuit is shown in FIG. 1 where a capacitor 10 is in parallel with a centre tapped inductor 11 and the circuit is shunted by a resistor 12. The centre tap of the inductor 11 is due to the dipole's balance to earth, and the radiation loss together with circuit component losses are represented by the resistor 12.

Capacitance measurements on antenna wire have shown that the characteristic impedance of a transmission line equivalent to the resonant circuit of FIG. 1 is about 1,000 ohms. Hence the reactance of the capacitor 10 is about −j1000 ohms and that of the inductor 11 +j1000 ohms. From VSWR measurements on a typical half-wave dipole antenna with a bandwidth of about 0.1 times its centre frequency, the resistance 12 is found to have a typical value of about 10 Kohm.

Figure 2:
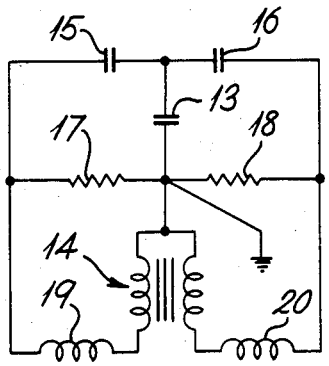
Fig. 2 PRIOR ART
FIG. 2 is an improved equivalent circuit for a half-wave dipole antenna.

As has also been mentioned there is a high degree of coupling between opposite halves of an open wire antenna and this is represented in the equivalent circuit of FIG. 2 by a capacitor 13 and an ideal transformer 14. Capacitors 15 and 16 replace the capacitor 10 and resistors 17 and 18 replace the resistor 12. While the resistors 17 and 18 each have resistances of about 5 Kohms, it is the capacitive reactance due to the capacitors 13 and 15 across the resistor 17 which is −j500 ohms. Similarly the capacitive reactance across the resistor 18 due to the capacitors 13 and 16 is also −j500 ohms. Inductors 19 and 20 replace the inductor 11 but the inductive reactances across the resistors 17 and 18 are respectively j500 ohms and each formed by one of the inductors 19 and 20 and half of the transformer 14.

For a half-wave dipole antenna fed from a coaxial feeder one half of the equivalent circuit of FIG. 2 can be represented by the equivalent circuit of FIG. 3*a*. Thus FIG. 2 is replaced by two unbalanced circuits which are back to back and single ended to earth each dissipating half the power of the circuit of FIG. 2. One of the benefits conferred by the high degree of coupling between opposite wires of an open wire antenna is that a single unbalanced feed will feed both halves of the antenna and thus provide an effective Balun.

The optimum point to connect the screen of the feeder is the electrical centre of the dipole but the position for the connection of the inner conductor of the feeder is required. In the Gamma match system feeding is by a connection 22 (see FIG. 3*b*) between a point some way along one of the two dipole antenna elements 23 and 24. The screen 25 of a coaxial feeder is connected to the centre point between the elements 23 and 24. However the length of wire 22 forms a significant series inductance and therefore another transformer arm 22' (FIG. 3*a*) presenting the feeder with an inductive load. The Gamma match system has been found to be of little use even when a trimming capacitor is included in the connection 22 and adjusted to tune out the unwanted inductance. This lack of utility is due to circuit Q restricting the effective bandwidth of operation.

If the half resonant-circuit of FIG. 2 is fed from the capacitive side by replacing the imaginary coupling capacitor 13 by two real capacitors 26 and 27 (see FIG. 4*b*), then the half resonant-circuit of FIG. 4*a* can be assumed and the feed point impedance can be made equal to the characteristic resistance of the coaxial line as described below.

The capacitive reactance of the capacitor 27 is selected so that when the whole circuit is in resonance, the common circulating current around the inductance 20', the capacitor 27 and the capacitor 16 produces a voltage step-up between the capacitor 27 and the capacitor 16 in proportion to the magnitude of their reactances and allows a 50 ohm feeder for example to match the 5 Kohm half load. Thus in this example if the capacitor 27 has one-ninth of the reactance of the capacitor 16 (that is 50 ohms), the necessary 10 times voltage step-up, and accompanying 100 times impedance step-up, is achieved.

The reactive load presented to the feeder 25 by the capacitor 27 is compensated by an inductor 28 of impedance 50 ohms which allows the feeder to see a resistive load impedance. For a coaxial line of another characteristic resistance the inductor 28 and capacitor 27 each have reactances equal to that characteristic resistance. In addition each of the capacitors 26 and 27 has a capacitance value whose ratio to the imaginary capacitor 16 is equal to $\sqrt{N-1}$ where N is the ratio of the characteristic resistance of the line to the resistance of the resistor 18', so giving the required step in impedance from the line to the antenna.

The ground plane antenna of FIG. 5 has a capacitor 27' connected between a resonant antenna element 23' and a ground plane conductor 29 which is in the form of a sheet of conducting material. Alternatively the ground plane conductor may be a mesh of conducting material or a radial array of wires. The element 23' is connected by way of an inductor 28' to the centre conductor of a coaxial line 25'. The capacitor 27' and the inductor 28' each have reactances equal to the characteristic resistance of the line 25'.

In another ground plane antenna according to the invention, the element 23' may be replaced by a wide cone of spaced wires connected at the cone apex and base, the capacitor 27' and the inductor 28' being connected to the base.

Now that the invention has been specifically described it will be seen that it can be put into operation in many other ways. For example the coaxial feeder can be replaced by any other unbalanced feed and the impedance of this unbalanced feed need not be 50 ohms. It is necessary that the impedance of the feeder is stepped up to that of the half resonant-circuit by the correct choice of the capacitor connected across the feed.

While the elements 23, 23' and 24 are usually a quarter of a free space wavelenth long at the centre of the frequency band of operation, these elements may be shortened by inductive loading (for example by means of loading coils 31 and 32 (see FIG. 6) at any position in the elements), and thickened or widened for broad band operation.

The elements 23 and 24 may be replaced for example by similar elements forming part of a folded dipole or by a Quad antenna. In a Quad antenna, a rectangular loop of wire having a peripheral length of one or more whole wavelengths is fed from a gap in one side of the rectangle where the two above mentioned capacitors are connected in series across the gap. The screen of the feeder is connected to the connection between the capacitors and the centre conductor of the feeder is connected by way of the inductor to one end of the loop adjacent to one of the capacitors. The inductive structure of the first aspect of the invention may be used as the driven element in other antennas according to the invention, for example many kinds of directional arrays such as a Yagi array (see FIG. 7), or a Quad array (using rectangular conducting loops as director and/or reflector elements), or a curtain array. The conductive structure of the first aspect of the invention may also be used for example alone or in a directional array at the focus of the parabolic reflector of another type of antenna according to the invention (see the reflector 33 in FIG. 8).

I claim:

1. An antenna for connection to an unbalanced feeder comprising a conductive structure which is resonant at the centre frequency of a predetermined operating band, the structure having first and second elongated conductor portions, each of said first and second elongated conductor portions having a first end, said first end of said first conductor portion being disposed adjacent said first end of said second conductor portion, a pair of capacitors connected in series between said first end of said first conductor portion and said first end of said second conductor portion and positioned adjacent to said first ends with the connection between said capacitors forming a connecting point for he 'common' connection of an unbalanced feeder, each said capacitor having a capacitive reactance at said centre frequency providing a phase shift of several tens of degrees between applied voltage and a current, and an inductor having one end connected to said first end of one of said first and second conductor portions, the other end of said inductor forming a connecting point for the 'live' connection of an unbalanced feeder, and said inductor having an inductive reactance at said centre frequency which compensates for said phase shift to present a substantially resistive impedance between said feeder connecting points at said centre frequency.

2. An antenna according to claim 1 which has an equivalent parallel resonant circuit comprising a measurable capacitance, a measurable inductance and a measurable resistance which represents the radiation loss and losses in the antenna components, wherein the capacitors of said pair are of substantially equal value, and the ratio of said value to twice the value of said measurable capacitance equals $\sqrt{N-1}$, where N is the ratio of the characteristic resistance of a predetermined unbalanced feeder to half the value of said measured resistance.

3. An antenna according to claim 1 wherein the antenna is a half-wave dipole, and the first and second portions are respective portions of first and second conductors which are generally oppositely directed and each a quarter of a wavelength long (±4%) at the said centre frequency.

4. An antenna according to claim 1 including an unbalanced feeder in the form of a coaxial line, the said common connection being the outer conductor of the line and the said 'live' connection being the inner conductor thereof.

5. An antenna according to claim 4 wherein the inductor connected between the inner conductor of the line and one of the elongated conductor portions has a reactance substantially equal to the characteristic impedance of the coaxial line.

6. An antenna according to claim 1, wherein the conductive structure forms antenna elements in a directional array of such elements.

7. An antenna according to claim 1, including a parabolic reflector with the first and second elongated conductor portions positioned at the focus of the reflector.

8. An antenna according to claim 1 wherein the inductor and each capacitor have an inductive reactance and a capacitive reactance, respectively, at the said centre frequency within the range 90 to 110% of the characteristic resistance of the unbalanced feeder.

9. An antenna according to claim 1 wherein the first and second conductor portions each include a loading coil.

10. A method of connecting an unbalanced feeder to an antenna having a conductive structure which is resonant at the centre frequency of a predetermined operating band, the structure having two elongated conductor portions each of said conductor portions having a first end, said first end of one said conductor portion being disposed adjacent said first end of the other said conductor portion, the method comprising connecting a pair of capacitors in series between said first end of said one conductor portion and said first end of said other conductor portion at a position adjacent to said first ends, each capacitor having a capacitive reactance at the said centre frequency providing a phase shift of several tens of degrees between applied voltage and current, connecting a 'common' terminal of the unbalanced feeder to the connection between the capacitors, and connecting a 'live' terminal of the unbalanced feeder to said first end of one of said conductor portions, by way of an inductor having an inductive reactance at the said centre frequency which compensates for the said phase shift to present a substantially resistive impedance to the feeder.

* * * * *